US005613271A

United States Patent [19]

Thomas

[11] Patent Number: 5,613,271

[45] Date of Patent: Mar. 25, 1997

[54] VACUUM CLEANER

[75] Inventor: Paul-Gerhard Thomas, Neunkirchen, Germany

[73] Assignee: Robert Thomas Metall- und Elektrowerke, Neunkirchen, Germany

[21] Appl. No.: 543,887

[22] Filed: Oct. 17, 1995

[30] Foreign Application Priority Data

Oct. 17, 1994 [DE] Germany ..... 9416655 U
Feb. 20, 1995 [DE] Germany ..... 295 02 793.2

[51] Int. Cl.[6] ..... A47L 11/34

[52] U.S. Cl. ..... 15/321; 15/322; 15/353; 15/367

[58] Field of Search ..... 15/321, 322, 353

[56] References Cited

U.S. PATENT DOCUMENTS

| | | | |
|---|---|---|---|
| 2,909,800 | 10/1959 | Grindle et al. | 15/322 X |
| 3,439,374 | 4/1969 | Wisdom | 15/322 X |
| 4,696,074 | 9/1987 | Cavalli | 15/322 X |
| 5,301,387 | 4/1994 | Thomas et al. | 15/322 |
| 5,400,462 | 3/1995 | Amoretti | 15/322 X |
| 5,459,901 | 10/1995 | Blase et al. | 15/322 X |
| 5,542,147 | 8/1996 | Merten | 15/321 |

FOREIGN PATENT DOCUMENTS

| | | | |
|---|---|---|---|
| 1286985 | 8/1972 | United Kingdom | 15/321 |

*Primary Examiner*—Chris K. Moore
*Attorney, Agent, or Firm*—Herbert Dubno

[57] ABSTRACT

A vacuum cleaner with a steam generator and a source of water under pressure has a suction hose connecting the suction head with the turbine and a dirt collector. Steam and pressurized water lines extend along the hose and the steam line runs to an orifice strip in a sole plate of the head while the spray nozzles are provided in a slot between a pair of brushes. The suction nozzle opens at a slot in the sole plate and sealing strips are provided along the longitudinal sides of the suction nozzle and the steam nozzle strip.

26 Claims, 7 Drawing Sheets

9
33
8
13
5
7
109
2
12
10
110
101
103
102
3
104
107
105
1
106
108
17
4
14
4
29
28
4
14
11
15
114

VACUUM CLEANER

FIELD OF THE INVENTION

My present invention relates to a vacuum cleaner and, more particularly, to a vacuum cleaner which also includes means for subjecting contaminants on the surface to be cleaned to steam.

BACKGROUND OF THE INVENTION

A vacuum cleaner can comprises a housing provided with a water receptacle with a steam generator, a receptacle for collecting the picked-up material, and a motor-driven turbine or other blower arrangement to generate suction through a suction hose which can be extended via extension wands and has at the end of the extension wands, a pick-up head at which the suction path terminates in a suction nozzle. That head can have a steam nozzle arrangement connected to the steam generator by a steam line.

Vacuum cleaners of this type have been used to pick up large particles and pieces and even liquids successfully and can even be used in the open to pick up leaves and the like. Typical of such systems are those described in U.S. Pat. No. 4,327,459 and DE-GM 91 10 171 which are equipped with means for subjecting the surface over which the head is displaced, to treatment with steam so as to remove contaminants which are difficult to pick up by suction alone.

The apparatus of U.S. Pat. No. 4,327,459 is excessively large and not conveniently handlable. The suction and steam nozzles are separate from one another and there are no seals which can ensure that the nozzles work effectively. The system of DE GM 91 10 171, however, can be more readily handled and the selective removability of the liquid tank simplifies refilling or emptying. However, that apparatus is lacking in the ability to act as an all-purpose vacuum with universal application.

OBJECTS OF THE INVENTION

It is the principal object of the present invention to provide a readily manipulatable vacuum-type cleaning device which has practically universal applications and for each possible application enables optimum cleaning.

Another object of the invention is to provide an improved vacuum cleaner which will avoid drawbacks of earlier systems and, especially, allows the vacuum cleaner to act as an all-purpose vacuum for the pick-up of fine and difficult to remove materials as well as large particles and materials.

SUMMARY OF THE INVENTION

These objects and others which will become apparent hereinafter are attained, in accordance with the invention in an all-purpose vacuum cleaner which has switching means on the handle which enables the vacuum cleaner to be used with or without the spraying of liquid at the pick-up head all in combination with the vacuum cleaning process and in a head which can operate optimally.

In particular, the vacuum cleaner of the invention can comprise:

a housing;

a water tank in the housing provided with a steam generator;

a receptacle for vacuumed material in the housing;

a motor-driven turbine in the housing disposed to generate suction;

a suction hose connected to the housing;

a suction head connected to the suction hose and having a sole plate adapted to ride over a floor to be vacuumed, the sole plate being formed with:

an elongated suction passage connected by a suction nozzle to the suction hose, yieldable sealing strips extending along opposite longitudinal sides of the suction passage, an elongated brush having a length corresponding substantially to a length of the suction passage and disposed ahead of one of the sealing strips in a direction of displacement of the suction head transverse to the passage and the strips, a nozzle strip ahead of the brush in the direction and provided with a row of steam orifices, and a pair of sealing lips flanking the nozzle strip; and a steam line extending from the steam generator to the steam orifices.

According to a feature of the invention, the sole plate has at least two brushes, between which a small slit is provided and that small slit diverges toward the upper side of the sole plate in a generally conical manner, the widening of the slit being provided with one or more spray nozzles which are positioned to spray a cleaning liquid into the slit and onto the upwardly divergent flanks thereof.

At least the feeder for the nozzle strip and, if provided, the spray nozzle, are controlled by switches or controllers which are provided at a bend in the suction duct, preferably at the handle of the latter at which the hose is connected to one or more extension wands. A switch box can be mounted on this handle or can be connectable thereto.

The steam line, the electric lines and, optionally, a pressurized water line can all run to the switch box and the steam line and the pressurized water line can be extendable to the suction nozzle by, for example, lengths of these lines which are provided along the extension wands. The lines can be provided in a common sheath or sleeve and the sheath or sleeve can be disposed within the suction duct or the suction duct can be subdivided internally to sections accommodating the aforementioned lines.

According to a feature of the invention the wands can be connected to each other and to the hose and to the suction head, and the lines themselves can be interconnected with extensions, etc., running to the head by plug-and-socket connecting joints.

Advantageously, the suction nozzle and the sole plate can be formed in one piece with one another or rigidly connected together. Alternatively, the suction nozzle and the sole plate can be releasably connected together so that they can easily be separated. The suction nozzle can have a free end which can be fitted into a groove of the sole plate in the longitudinal direction of the groove and can be formfittingly held therein by a tongue-and-groove connection.

Alternatively, the suction nozzle can have its free end inserted in a groove of the sole plate in a direction normal to the longitudinal dimension of the groove and can be retained there by a latching lever or springs in a form-fitting manner.

The electrically-heated steam generator can be fed from a reservoir via a feed pump. Alternatively the electrically-heated evaporator can contain the water to be evaporated and the heating is regulated via a pressure-monitoring sensor and with an overheating-prevention circuit. The steam flow from the steam generator can be set by a manually-adjustable valve downstream of the steam generator.

For supplying a feed pump for the spray nozzles, a spray-liquid receptacle can be inserted into the housing on guide elements and can be locked or latched in place. An outlet of this reservoir can be blocked by an automatic self-closing valve operating upon removal of the reservoir. In one embodiment of the invention, the spray liquid reservoir is inserted vertically at the back of the housing.

The dirt-collecting receptacle or paper dust-collecting bag can be mounted in or on the housing selectively or alternatively. The dust-collecting bag can be releasably retained by a plug-in plate having downwardly bent flanks in a U configuration for receiving the bag. The dust-collecting bag can have a length such that the bag can be shifted relative to the bag holder so that an opening is rendered accessible to communicate with the suction units of the vacuum cleaner.

The vacuum cleaner can be controlled by a microprocessor responsive to sensors (pressure or temperature sensors) and to a manually-actuatable switch.

The dust-collecting container can communicate with the suction duct via a box open at one side and the bottom of the box can be elongated in the direction of this opening while diagonally opposite the latter a discharge passage can be provided. The collecting container can be formed at this lower portion with a honeycomb or like body with vertical partitions. A resilient steel can seal the cover relative to the collecting vessel.

Upstream of the discharge passage, a float valve can be provided from which water can flow should the water level exceed a predetermined level.

The outlet passage can be provided with an impingement baffle filter.

The discharge passage can have a pressure sensor which can shut down the turbine motor and/or operate a signal lamp when a predetermined level of suction is exceeded.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
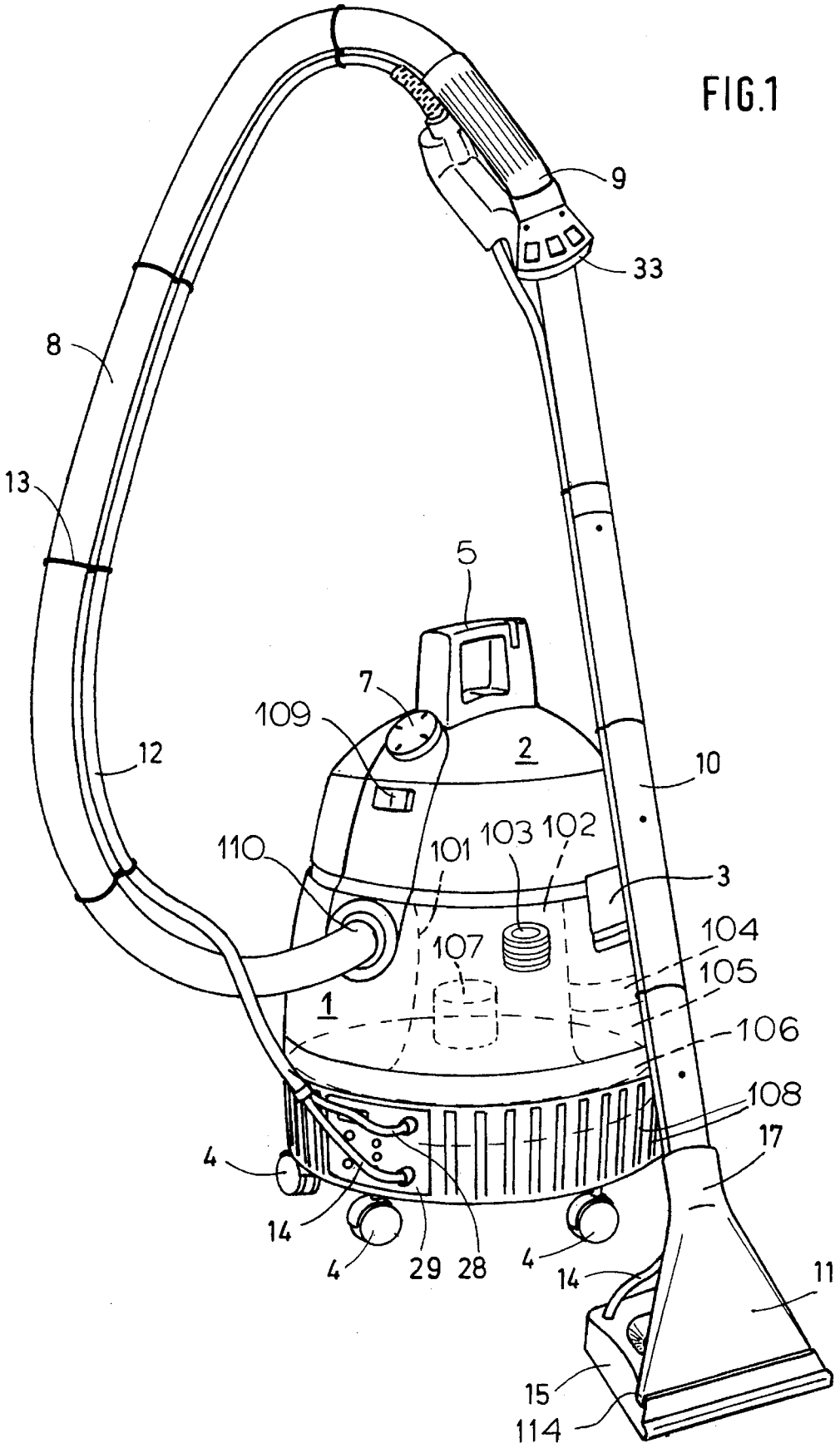
FIG. 1 is a perspective view of a vacuum cleaner in accordance with the invention.

FIG. 1 shows in a perspective view an all-purpose vacuum cleaner utilizing principles of the invention in which the housing 1 is provided with a hood 2 which can be releasibly connected to the housing via toggle latches 3. To facilitate the handling of the vacuum cleaner, the housing can be displaceable on four double-swivel casters 4 while the hood 2 is provided with a handle 5.

In the housing, a dirt-collecting vessel 101 can be received and which, upon removal of the hood 2, can be drawn upwardly via a handle, loop or the like so that it can be removed from the housing. The housing 1 also comprises a water tank 102 closed by a threaded plug 103 through which the water tank can be filled for storing water. Within this housing, in addition, a steam generator 104 supplied by a feed pump 105 can be provided, drawing water from the reservoir 102 and feeding that water to the electrically-heated steam generator to produce steam in the housing.

Also within the housing there is a turbine, generally represented at 106, driven by a motor 107 for inducing suction in the interior of the housing and drawing contaminants into the vessel 101. The air drawn into the housing is vented through the slits 108. The filling cap 103 is provided with a safety valve not shown in detail. The filling cap 103 is provided with a safety valve not shown in detail. The turbine 106 can, if desired, also be provided in the hood 2.

In either case the hood 2 is provided with an on-off switch 109 for the turbine and a control 7 for the speed of the turbine, i.e. the level of suction which is developed by the vacuum cleaner. Turbines, receptacles for receiving the contaminants, and steam generators are known in the art and have not been described in greater detail here. It suffices to observe that the vacuum cleaner can be provided with a microprocessor controller which receives inputs from the speed regulator 7 from pressure sensors and the like and from the manually-operated switch 109 as may be required.

As is apparent from FIG. 1, however, a suction hose 8 is connected by a plug-and-socket feeding 110 to the housing and particularly to the receptacle 101 for collecting the contaminants at the free end of this suction hose 8, a tube bend from the handle 9 is provided and extension wands 110, fitted together and to the handle 9 by conventional plug-and-socket joints, can be provided to extend the suction path to a suction nozzle 11 forming a head with a sole plate 15 at the end of the wands. Extending along the hose and the wand, is a steam line 14 and a pressurized water line 28 which, together with any electrical lines for control purposes, are received in a tubular sleeve 12 which can be affixed by clips, ties or elastic bands 13 with the hose and the wand.

Figure 2A:
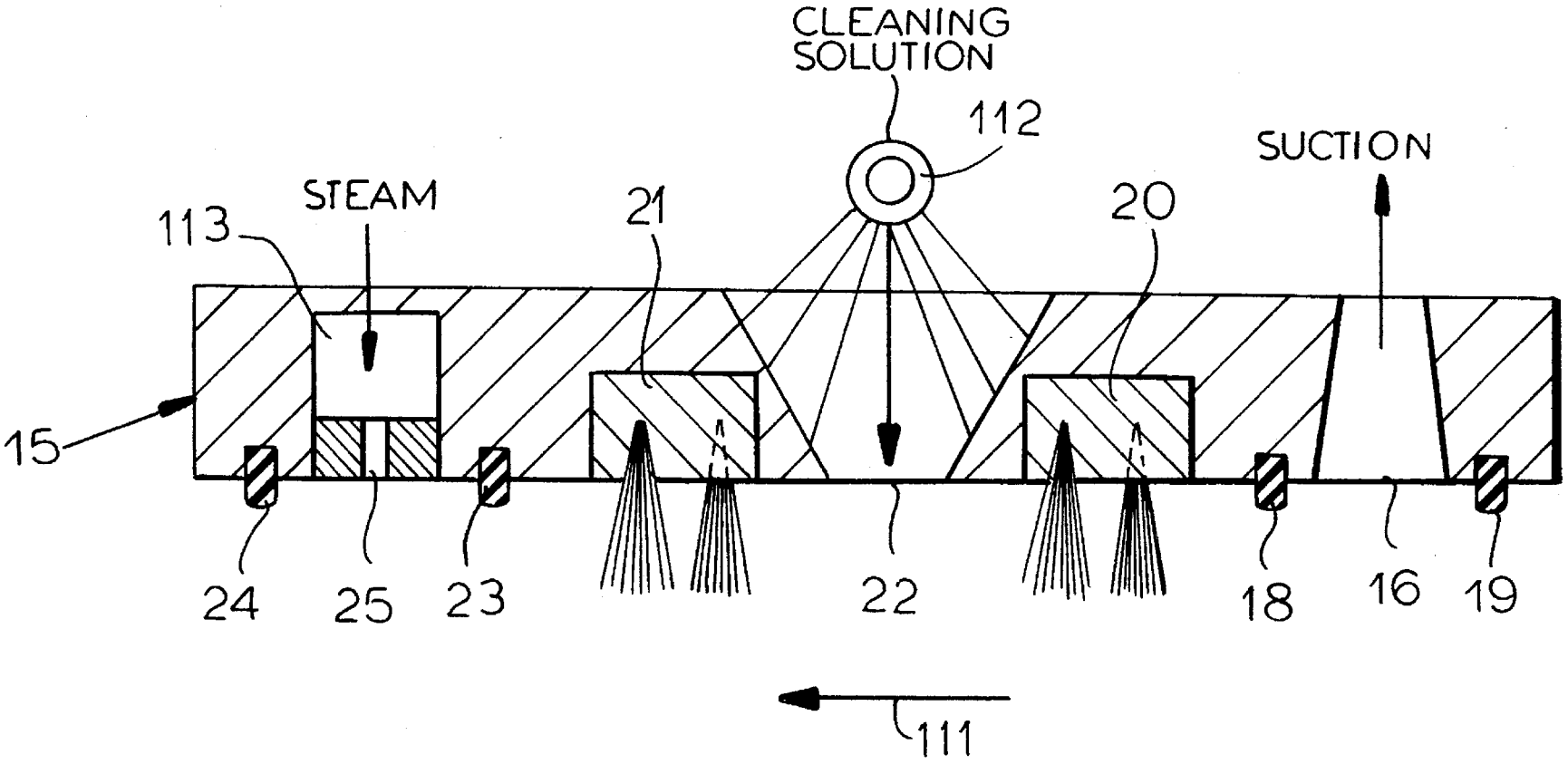
FIG. 2A is a diagrammatic section through the sole plate of this head.
Figure 2:
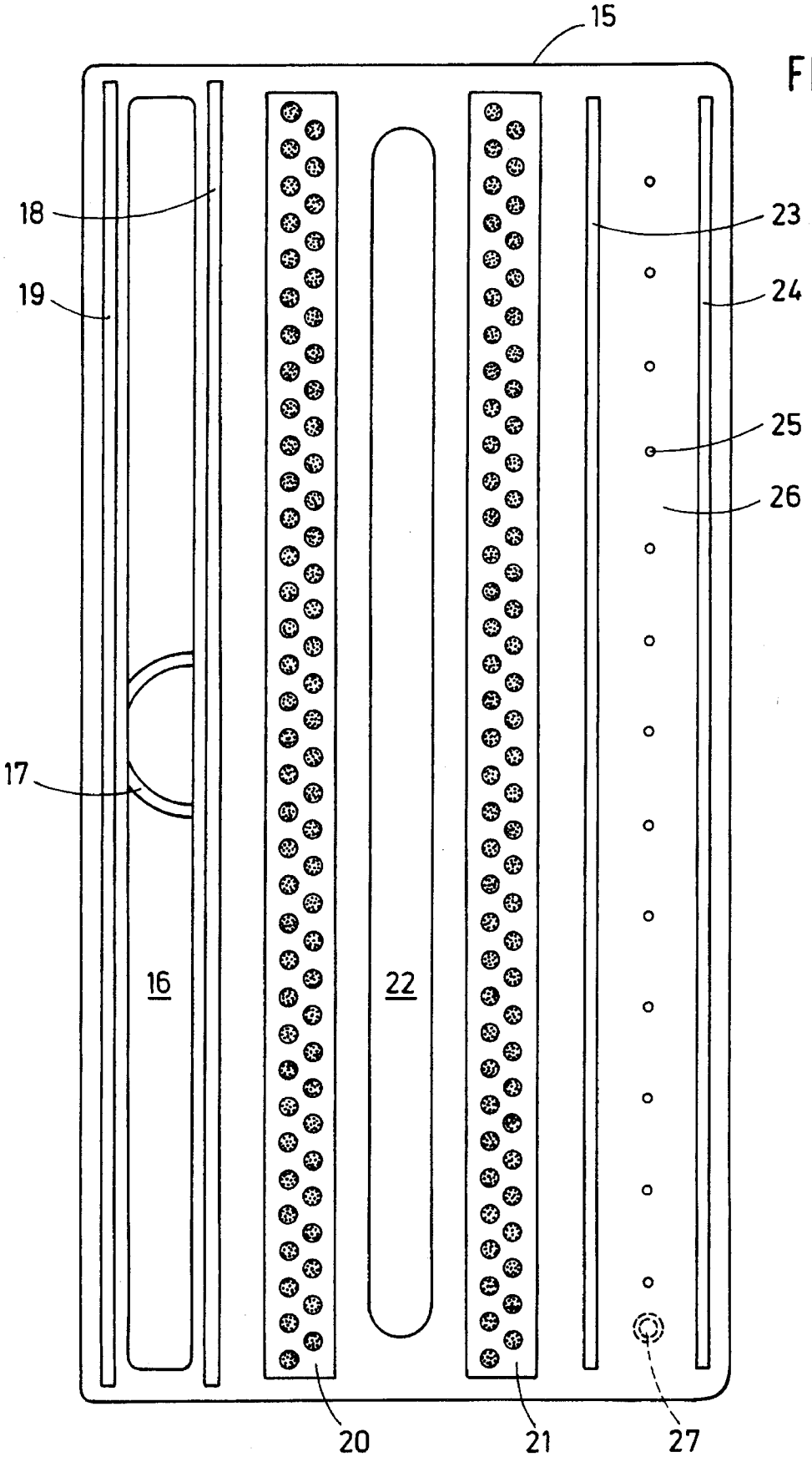
FIG. 2 is a bottom view of the head of the vacuum cleaner of FIG. 1.

As is apparent from FIGS. 2 and 2A, the underside of the suction nozzle 11 and the sole plate 15 shows that at the left side of the suction plate in FIG. 2 on the right side in FIG. 2A, assuming a direction of displacement represented by the arrow 111, the sole plate has a slot-like opening 16 communicating with the suction duct of the hose 8 and the nozzle 11. As can be seen from FIG. 1, the suction nozzle 11 can converge away from this slot 16 toward the port 17 by the wand 10 is connected to the nozzle 11.

On both longitudinal sides of the suction slot 16, yieldable sealing strips 18 and 19, e.g. of an elastomer, are seated in the grooves of the sole plate 15. These sealing strips 18 and 19 limit the influx of ambient air to maximize the suction applied to the surface to be cleaned.

Ahead the suction slot 18 and further to the right in FIG. 2, two brushes 10 and 21 are seated in the sole plate 15 and between these brushes a slit 22 is formed. This slit conically widens toward the upper side of the sole plate 15 (see FIG. 2A).

Water or some other cleaning solution can be sprayed by nozzles 112 into the slit from above, the water being delivered by a pressure pump and the pressure line 18 mentioned earlier.

The sole plate 15 is also provided with a pair of sealing lips 23 and 24 of elastomeric material, between which a nozzle strip 26 is provided. The nozzle strip is formed with orifices 15 communicating with a steam plenum 113 connected to the steam generator by the line 14. A connection 27 (FIG. 2) is provided between the plenum 113 and line 14.

The sole plate 15 can be formed in one piece with the suction nozzle 11. It is, however, advantageous to provide the sole plate as an accessory which can be attached to a conventional suction nozzle so that this can be simply fitted to the sole plate and held in a groove of the latter via a collar or tongue-and-groove connection as represented at 114 in FIG. 1. In this case, the front part of the sole plate 15 accommodating the suction nozzle can be provided with a groove in alignment with the slot 16 and the nozzle 11 can be formfitted to this groove.

The nozzle may be connected to the sole plate by a hook, undercut, latch or other arrangement and, for example, the nozzle or sole plate can be provided with resilient tongues which can engage in the other or spring clips can be provided as is common with vacuum cleaner parts to hold the two together.

With the sole plate of the invention, normal dust can be sucked up, or, if desired, steam can be applied to the surface to be cleaned via the nozzle strip 26, or in the alternative, or additionally water can be sprayed onto the surface, e.g. via the nozzles 112. From the spray nozzles, a fan-shaped spray can be formed which is trained upon the slit 22 and the flanks thereof can be delivered by the slit 22 to the ground. Steam and sprayed water can be switched on alternatively with excellent cleaning effectiveness.

It should be apparent that with the arrangement of the nozzle head illustrated in FIGS. 2 and 2A, after a region of the surface to be cleaned is subjected with steam and thus to higher temperatures at which soil may be more readily removable, the region is rubbed with the brush 21 and then subjected to water from the spray nozzles 112 via the slit 22 so that contaminants liberated by the steam are fully dissolved or picked up in the sprayed water and flushed away. The brush 22 increases the effect of loosening the soil which can then be sucked up through the suction slit 16. The sprayed liquid can include detergent, solvent or other cleaning assist and when strong suction is applied, it can act in part to dry the treated region.

The suction effect is not only strong by reason of the power of the turbine or suction blower, but because the suction field is limited to the region between the sealing lips 18 and 19 so that only a limited region of the carpet is subject to the powerful suction from the slit. The sealing lips 18 and 19, of course, rub on the carpet as well and thus increase the cleaning effect. Surrounding air does not flow into the slit 16 but rather the air flowing into the slit is drawn primarily through the carpet or other fabric to be cleaned. It has been found to be advantageous to join the steam line 14 and the pressurized liquid line 28 with the hose 16 for feeding the spray nozzle. However it is possible to also include these lines and any requisite electrical lines in a compartment of the hose 8.

Figure 3:
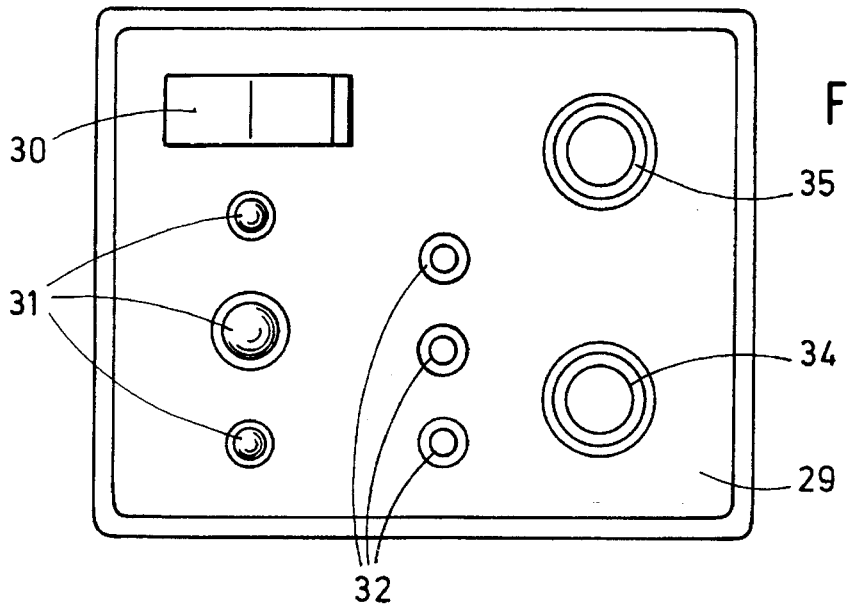
FIG. 3 is a view which is enlarged relative to FIG. 1 of a connecting plate for the housing for use with that vacuum cleaner.

As can be seen from FIG. 3, the housing may be provided with a control panel which has been represented at 29 and can be provided on the housing 1 at the lower part thereof as shown in FIG. 1. In this case, the control panel 29 can be provided with a manual switch 30 and three control lamps 31 which indicate the operational state of the turbine, the spray water pressure pump and the feed pump for the steam generator, respectively, or the readiness of these devices and/or the development of operating suction in the hose 8. The control switches for these devices, however, are generally not provided on the panel 29 but rather on a switch box 33 at the handle 9, the electrical lines from the switches to the panel 29 being connected to the latter through jacks 32. A steam coupling 34 facilitates connection of the steam line 14 to the housing while a pressurized water coupling 35 serves for connection of the pressure line 28. These couplings can contain valves which suppress delivery of steam or water under pressure until the respective lines have been properly connected. Each of the jacks 32 can be multiple jacks which can be associated with or connected at the same time as the steam or pressurized water coupling or the like with which the line may be associated.

Figure 4:
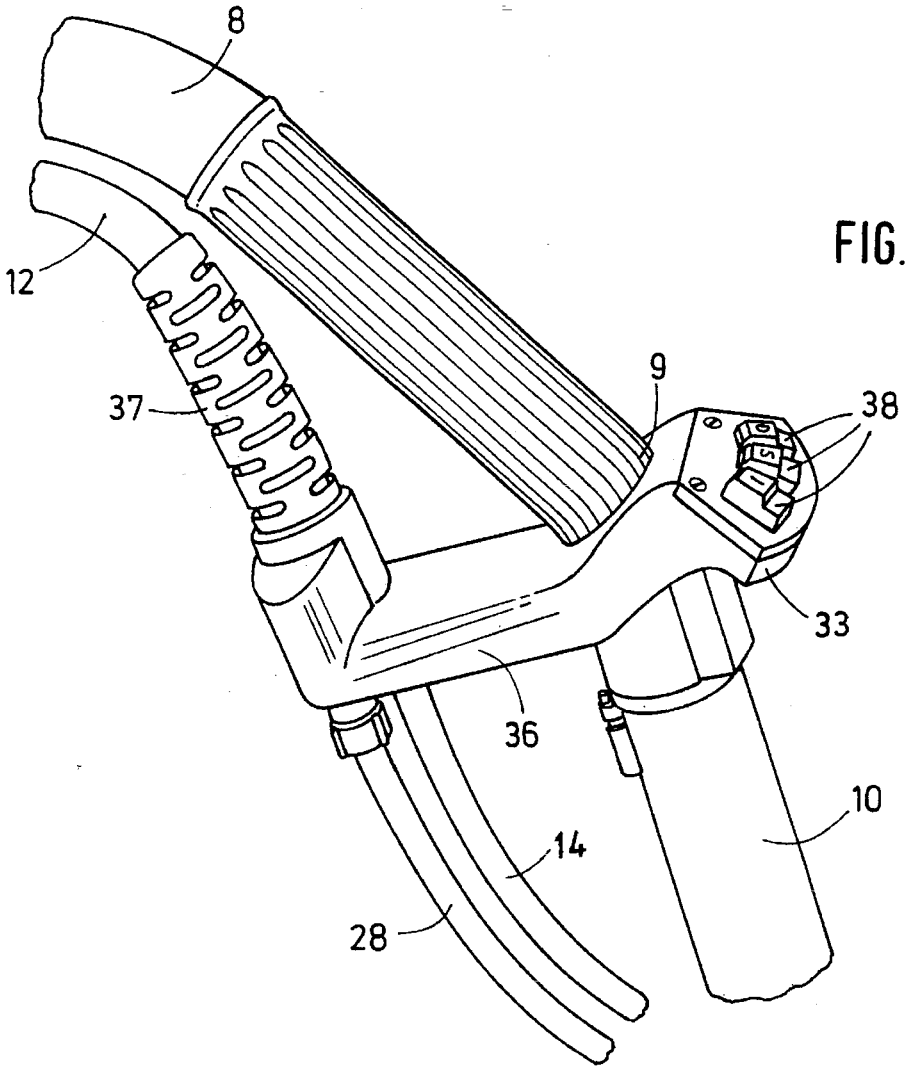
FIG. 4 is a detail of the handle portion between the hose and wand of the vacuum cleaner showing the control elements.

As can be seen from FIGS. 1 and 4, the switchbox 33 can have respective control switches 38 for the particular mode of operation, i.e. for switching on the suction, for outputting steam and for outputting water under pressure. The switchbox 33 is connected directly to the handle 9 upstream of the first extension wand 10 and has an outrigger 36 which lines support the lines 14 and 28 and terminates the sleeve 12 at an antibuckling sleeve 37. The electric lines in sleeve 12 can be fed through the outrigger 36 to the switchbox while the steam and water lines 14 and 28 are connected to the outrigger 36 by releasable couplings.

The all-purpose vacuum of the invention thus not only is effective for a variety of cleaning purposes but it can induce pile of the carpeting to stand erect during the drying following a highly effective mechanical and vacuum-cleaning operation.

Figure 5:
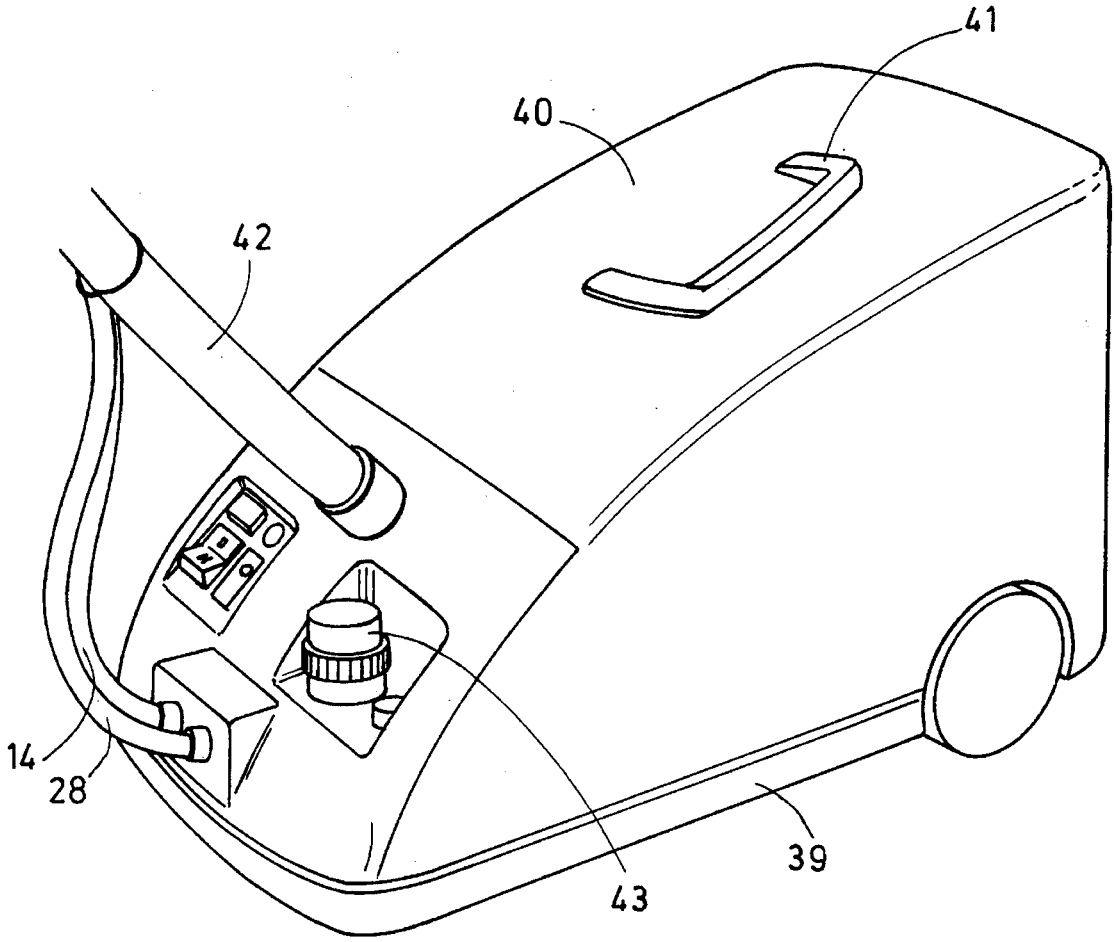
FIG. 5 is a fragmentary perspective view of another vacuum cleaner according to the invention.

A somewhat smaller version of a vacuum cleaner according to the invention has been shown in FIG. 5 and has a fixed lower part 39 connected by a hinge to a hood 40 having a handle 41 which can be swung upwardly into a working position. The turbine with its drive motor can here be mounted in the lower part 39, preferably with a vertically-oriented axis. The hose 8 of FIG. 1 can be used here although it is also possible to provide a hose 42 which has a free interior or one through which the lines 14 and 28 are guided and subdivided from the suction space by a partition. A filling cap 43 can supply the feed pump of the evaporator or a reservoir upstream thereof. A container for the water to be sprayed is directly removable upon release and swinging back of the hood 40. An outlet of the container is connected by a coupling to the inlet side of a pressure pump for the liquid to be sprayed and with a blocking valve which opens automatically upon insertion of the reservoir into the inlet to the pressure pump. This allows the reservoir to be removed from the housing, filled and replaced without water leakage. The filling of the container can be simplified by providing the hood 40 as a type of cover which does not extend to the rear wall of the device. The reservoir can then be inserted substantially vertically into a region of the housing near the rear wall and held in place by latching or locking of the closed cover. In this case the container itself can also be filled without the need for opening the cover or hood.

A further simplification of the construction of the invention has, instead of a reservoir which feeds a pump and a pump which supplies the steam generator, a reservoir and steam generator in a common receptacle which can have a volume of, say, two liters and can be provided with the heating device which is necessary for steam generation.

The heating device can then be pressure-controlled and can be shut down, for example, by the attainment of a steam pressure of say 4 bar. Signalling of the operational state can also be effected by the pressure sensor and via the microprocessor upon the attainment of a first pressure, a control lamp can be energized to indicate operational readiness. At a second higher pressure, the heating device can be shut down utilizing two point control. It is however also possible to use pressure regulation to control the heating device in response to a plurality of pressure values so that at a pressure above the second pressure, the heating is reduced or one heating element is cut out while complete cut-out of heating is only effected after a further higher pressure value is attained.

Fine setting of the steam flow can be effected via a needle valve and indeed, operation of the steam boiler utilizing a microprocessor is preferred, the microprocessor being responsive to a pressure sensor and being associated with a temperature-regulating circuit which prevents thermal overheating, evaporation to dryness of the water or the like in response to a temperature-monitoring element.

Figure 6:
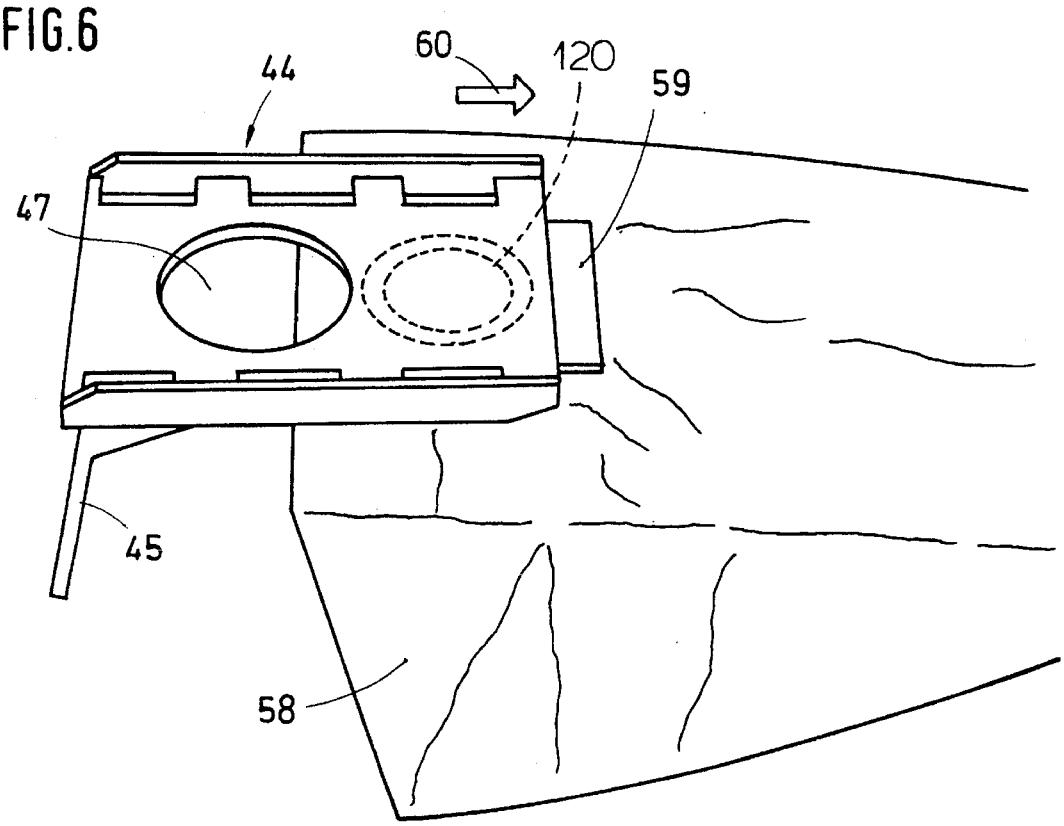
FIG. 6 is a perspective view of the holder and dust-collecting bag for this vacuum cleaner.
Figure 8:
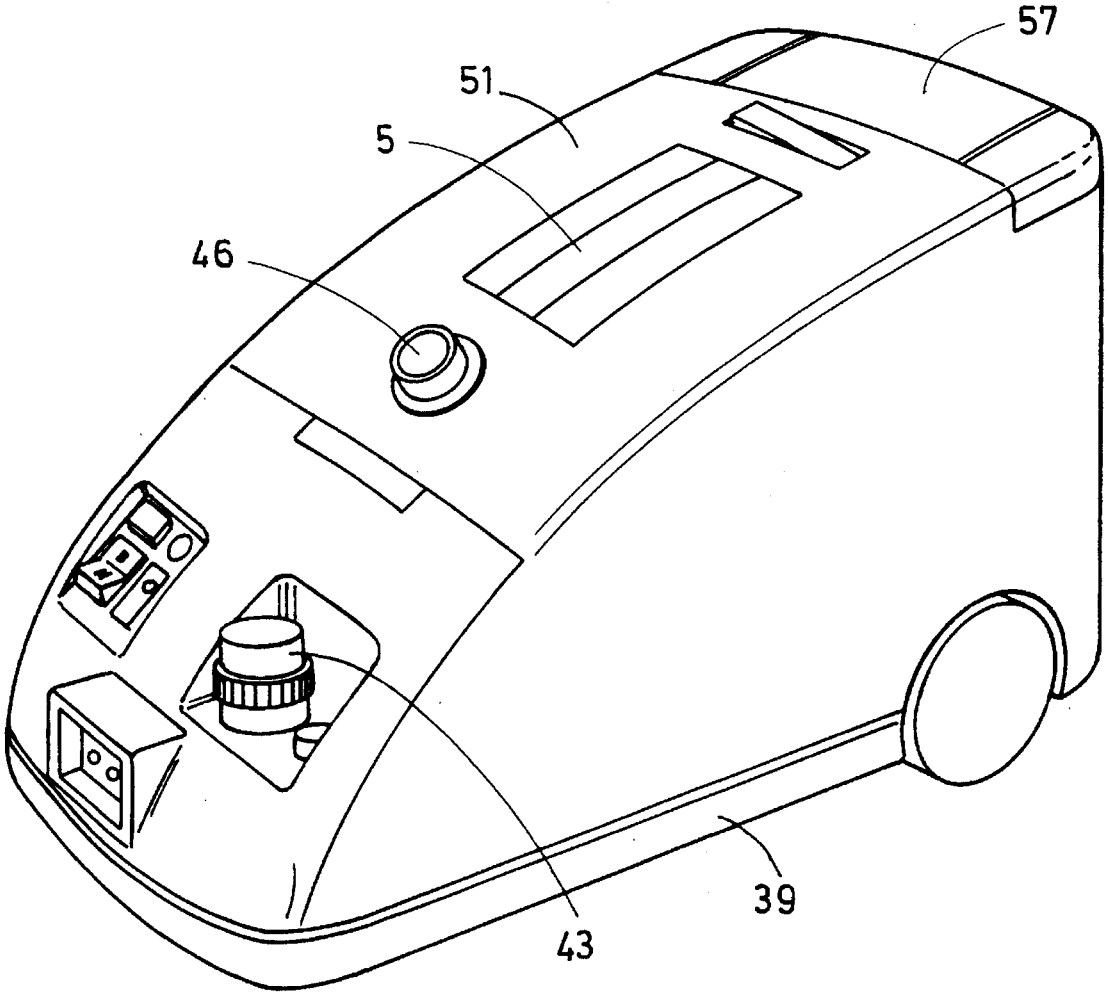
FIG. 8 is a schematic perspective view of still another vacuum cleaner embodying the invention.

For simple vacuum cleaning operation, operational with steam feed, a conventional dust-collecting bag can be used, preferably in the form of a disposable paper bag as shown, for example, in FIG. 6. The dust-collecting bag may be provided with a holder 44 with a plate 45 which plugs into the machine and has a downwardly-bent flange by means of which it is positioned below the suction hose 42 or the suction fitting 46 (FIG. 8).

The suction hose or fitting is thus located directly above the opening 47 in the holder 44. The flanks 48 of the dust holder are bent downwardly in a U configuration so that grooves are formed on opposite sides into which the base plate 59 of the dust-collecting bag can be slid. In its operating position, the hole 120 of the plate 59 is aligned with the opening 47 and the air sucked into the housing can be filtered through the bag, the dust collected therein and the out-flowing air cleaned. For removal, the plate of the bag is shifted relative to the holder 44 to close the hole 120 and the bag is lifted with the holder from the machine and carried to a disposal container. The bag can then be removed from the holder which can be reused or discarded with the holder 8.

When the vacuum cleaner is used to suck up water, whether it is water dispensed by the nozzle or water which must be removed from the surface to be cleaned, the dust bag is removed and replaced by a collecting container. The water which is sucked up must be drawn into the hose at relatively high speed to ensure that it will be entrained. This water must be separated from the air before the air reaches the turbine and, because of the acceleration of the water and the fact that it is broken up by the high velocity and suction, poses substantial problems in separation from the entraining air.

Figure 7:
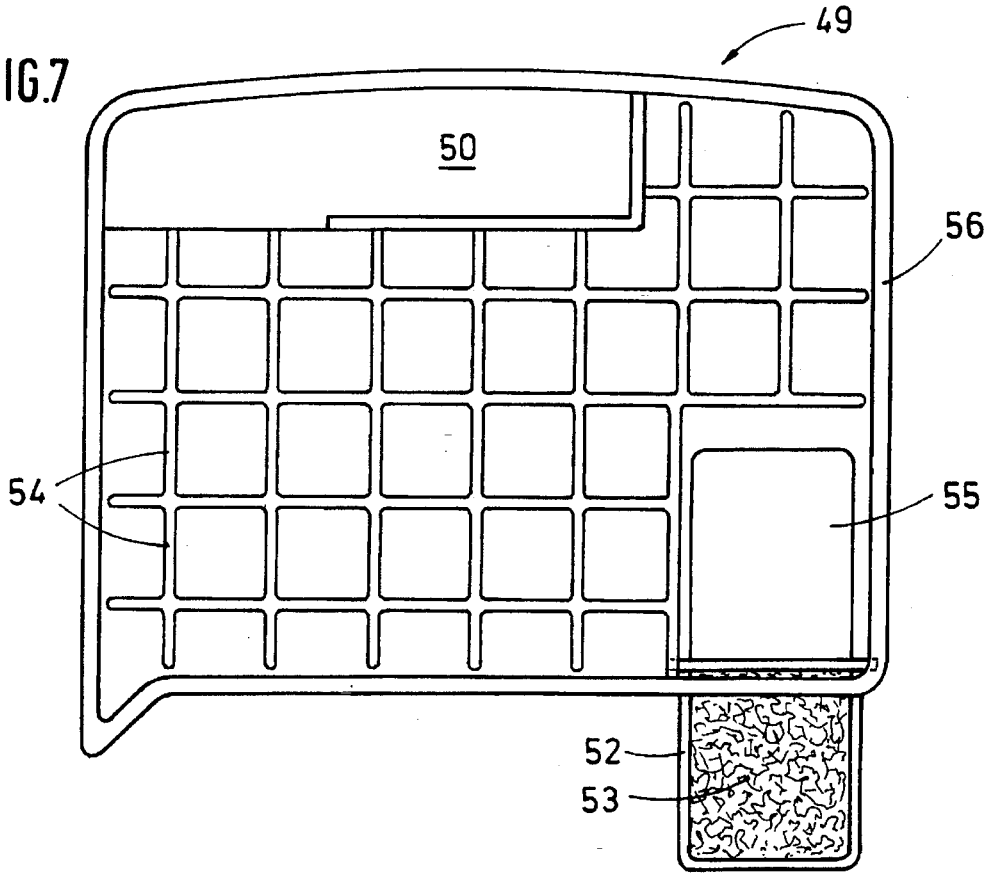
FIG. 7 is a plan view of a dust-collecting receptacle.

To separate the water from the air, the invention provides a collecting container as shown in FIG. 7 which has been found to be especially effective not only because it can remove the greater part of the water but because it can be of comparatively low height and avoids vibration and water surges.

In the vacuum cleaner of FIG. 5, not only is the cover sealed with respect to the housing with yieldable (elastomeric) seals to seal off the suction space and exclude ambient air, but the suction wands and hose are sealed with respect to the housing and each other and additional seals are provided at 56 (FIG. 7) to seal between the collection vessel and the remainder of the housing.

As can be seen from FIG. 7 which is a top view of the vessel, the latter is a laterally and upwardly open box-like structure 50 which is elongated toward the open side and which cooperates with the cover 51 of the vacuum cleaner of FIG. 8 when the latter is closed thereagainst. The fitting 46 opens directly into the vessel 49.

Water and particles entrained in the airstream are initially deflected by the box structure to the left side walls of the receptacle 49 and by these walls through 90° along the walls. When the airstream reaches the undercut corner, it is eddied and braked and deflected along the rear wall, (bottom in FIG. 7) to impinge upon the opposite side wall before being discharged through a discharge passage 52.

The passage is provided with an impingement filter which acts as a noise suppression filter and can be composed of steel wood, large-cell foam plastic or the like.

The bottom of the collecting container is formed with upstanding webs in a honeycomb or lattice configuration as represented at 54. The vertical walls of this structure form passages which intersept the airstream and further brake it while developing eddies therein. The entire vessel thus acts as an impingement baffle filter collecting water and contaminants. The baffles prevent the water from surging in the container 49.

To avoid overfilling of the vessel 49 with water, the outlet passage 52 has a float 55 which rises as the level of water rises and closes the inlet into the outlet passage 52. As a consequence, the suction level in the collecting vessel 49 diminishes sharply while in the outlet passage 52 and the sealing space between this passage and the inlet to the turbine is subjected to sharply increased suction which, because of the practically zero displacement, is partly relieved so that the motor tends to operate at a higher speed than previously.

This increased suction is detected by a sensor and the microcomputer which cuts off the drive motor. The vacuum cleaner can then be serviced by emptying the collection vessel. When water is not to be collected, the vessel 49 can be replaced by the dust bag 44.

FIG. 8 shows a vacuum cleaner similar to FIG. 5 in which the cover is comparatively short so that it terminates ahead of the receptacle 57 for the spray liquid and which, therefore, does not require removal of the cover 51 for refilling.

The suction fitting 46 is here provided on the cover 51 so that it can be more readily sealed against the dust bag 44 or the receptacle 49.

I claim:

1. A vacuum cleaner comprising:

a housing;

a water tank in said housing provided with a steam generator;

a receptacle for vacuumed material in said housing;

a motor-driven turbine in said housing disposed to generate suction;

a suction hose connected to said housing;

a suction head connected to said suction hose and having a sole plate adapted to ride over a floor to be vacuumed, said sole plate being formed with:

an elongated suction passage connected by a suction nozzle to said suction hose, yieldable sealing strips extending along opposite longitudinal sides of said suction passage, an elongated brush having a length corresponding substantially to a length of said suction passage and disposed ahead of one of said sealing strips in a direction of displacement of said suction head transverse to said passage and said strips, a nozzle strip ahead of said brush in said direction and provided with a row of steam orifices, and a pair of sealing lips flanking said nozzle strip; and a steam line extending from said steam generator to said steam orifices.

2. The vacuum cleaner defined in claim 1 wherein the sole plate is provided with at least two brushes between which a small slit is formed diverging toward an upper side of said sole plate and juxtaposed with at least one spray nozzle supplied with a cleaning liquid.

3. The vacuum cleaner defined in claim 1 wherein said nozzle strip is supplied through a control at a handle of said hose, said control being formed as part of a switching unit on said hose.

4. The vacuum cleaner defined in claim 3 wherein said steam line, an electric line and pressurized water line extend along said hose to said unit, said hose being provided with extension wands running to said head and along which said steam line and pressurized water line run to said head.

5. The vacuum cleaner defined in claim 4 wherein said lines are disposed in a common tube.

6. The vacuum cleaner defined in claim 5 wherein said tube is disposed in said hose.

7. The vacuum cleaner defined in claim 1, further comprising a plurality of extension wands connected together and to said hose by plug-and-socket joints, said head being connectable to said extension wands by a plug-and-socket joint.

8. The vacuum cleaner defined in claim 1 wherein said suction nozzle is formed in one piece with said sole plate.

9. The vacuum cleaner defined in claim 1 wherein said suction nozzle and the sole plate are provided with a releasable connection with one another.

10. The vacuum cleaner defined in claim 9 wherein said suction nozzle has a free end receivable in a groove formed in said sole plate and is retained therein by form-fitting engagement of said groove and said suction nozzle.

11. The vacuum cleaner defined in claim 9 wherein said suction nozzle has a free end engageable in a groove of said sole plate by insertion in a direction normal to a longitudinal dimension of the groove and is form-fittingly retained therein by locking means.

12. The vacuum cleaner defined in claim 1 wherein said steam generator is an electrically-heated evaporator connected with said water tank by a feed pump.

13. The vacuum cleaner defined in claim 1 wherein said steam generator is an electrically-heated evaporator provided with a pressure monitor and overheating protection.

14. The vacuum cleaner defined in claim 1 wherein said steam generator has a valve downstream thereof and manually adjustable to control steam flow from said steam generator.

15. The vacuum cleaner defined in claim 1 wherein a feed pump is provided for supplying a cleaning liquid to a spray nozzle of said head, said housing being provided with a spray liquid container connected by a self-closing valve with said pump.

16. The vacuum cleaner defined in claim 15 wherein said container is insertable into said housing substantially vertically at a back of said housing.

17. The vacuum cleaner defined in claim 1, further comprising means for selectively mounting said receptacle for a paper bag to receive vacuumed material in said housing.

18. The vacuum cleaner defined in claim 17, further comprising a bag holder releasably retained on said housing with a plate with bent flanks and a U cross section.

19. The vacuum cleaner defined in claim 18 wherein said bag holder has a length such that the bag can be shifted relative to the bag holder to completely expose an opening communicating with the bag.

20. The vacuum cleaner defined in claim 1, further comprising sensors including pressure and temperature sensors providing input to a microprocessor, and further comprising a manually actuatable switch for operating such microprocessor.

21. The vacuum cleaner defined in claim 1 wherein said receptacle has a suction fitting aligned with an open box and said receptacle is elongated in the direction of this box and is provided diagonally opposite a discharge passage.

22. The vacuum cleaner defined in claim 21 wherein said discharge passage has a float valve which floats upon the development of a water level exceeding a predetermined water level.

23. The vacuum cleaner defined in claim 21 wherein said discharge passage has a pressure sensor downstream thereof and which, upon detection of a suction exceeding a predetermined suction level, turns off a motor driving said turbine.

24. The vacuum cleaner defined in claim 1 wherein said receptacle is formed at a lower region with a latticework with a vertically oriented lattice.

25. The vacuum cleaner defined in claim 1 wherein said receptacle has a cover and a yieldable seal engageable with the cover.

26. The vacuum cleaner defined in claim 1 wherein said discharge passage is provided with a noise filter.

* * * * *